United States Patent [19]

Allen

[11] Patent Number: 4,721,443

[45] Date of Patent: Jan. 26, 1988

[54] DISCHARGE VALVE RETAINER FOR A COMPRESSOR

[75] Inventor: Charles C. Allen, Tecumseh, Mich.

[73] Assignee: Tecumseh Products Company, Tecumseh, Mich.

[21] Appl. No.: 25,960

[22] Filed: Mar. 16, 1987

[51] Int. Cl.[4] ..... F04B 39/10; F04B 21/02

[52] U.S. Cl. ..... 417/539; 417/559; 417/571

[58] Field of Search ..... 417/559, 539, 529, 564, 417/566, 269; 137/856

[56] References Cited

U.S. PATENT DOCUMENTS

| | | | |
|---|---|---|---|
| Re. 15,472 | 10/1922 | Riesner . | |
| 1,416,696 | 5/1922 | Dennedy . | |
| 1,629,495 | 5/1927 | Frankenberg . | |
| 1,764,953 | 6/1930 | Heath . | |
| 2,011,079 | 8/1935 | Replogle . | |
| 2,089,706 | 8/1937 | Orr | 417/559 |
| 2,194,726 | 3/1940 | Thomas . | |
| 2,302,448 | 11/1942 | Leonard . | |
| 2,797,647 | 7/1957 | Floraday | 417/566 |
| 2,846,140 | 8/1958 | Kemper | 417/539 |
| 2,913,168 | 11/1959 | Heidorn | 417/269 |
| 3,039,487 | 6/1962 | Doeg | 137/516.11 |
| 3,241,748 | 3/1966 | Cramer | 417/571 |
| 3,472,446 | 10/1969 | Linnert | 417/539 |
| 3,777,622 | 12/1973 | Hause | 91/479 |
| 3,784,331 | 1/1974 | Heidorn | 417/273 |
| 3,807,910 | 4/1974 | Paget | 417/564 |
| 3,887,301 | 6/1975 | Henkel | 417/53 |
| 3,998,571 | 12/1976 | Falke | 417/569 |
| 4,172,696 | 10/1979 | Gyory | 417/564 |
| 4,273,519 | 6/1981 | Gannaway | 417/273 |
| 4,325,680 | 4/1982 | Bar | 417/569 |
| 4,352,640 | 10/1982 | Takamatsu et al. | 417/273 |
| 4,469,126 | 9/1984 | Simpson | 137/543 |
| 4,470,774 | 9/1984 | Chambers | 417/567 |
| 4,537,566 | 8/1985 | Blass et al. | 417/569 |

FOREIGN PATENT DOCUMENTS

| | | | |
|---|---|---|---|
| 93674 | 11/1983 | European Pat. Off. | 417/566 |
| 140777 | 3/1980 | German Democratic Rep. | 417/559 |
| 18866 | 1/1982 | Japan | 137/856 |

*Primary Examiner*—William L. Freeh

*Attorney, Agent, or Firm*—Jeffers, Hoffman & Niewyk

[57] ABSTRACT

A discharge valve retainer for a compressor with at least two arcuately-shaped, annular segments which segments are joined together. By joining the annular segments together, a retainer structure having a very rigid central portion results, thereby reducing stress and fatigue of the retainer. The discharge ports are arranged in an annular fashion and the suction ports are disposed radially inside the annularly arranged discharge ports.

9 Claims, 5 Drawing Figures

DISCHARGE VALVE RETAINER FOR A COMPRESSOR

BACKGROUND OF THE INVENTION

This application broadly relates to fluid pumps or compressors for compressing fluids such as refrigerant gasses. More specifically, the invention relates to discharge valve retainers and particularly a dual retainer structure for discharge vlves on multiple cylinders.

Prior types of retainers for valves, particularly for valves in compressors and the like, include singular, cantilever structures; spring loaded or biased retainers; or centrally pinned or pegged curved retainers. Retainers for compressor or pump valves broadly fall in two general classes. The first class includes a retainer secured to the valve plate at a radial distance to one side of the valve. The resilient, metal leaf valves or flappers are restrained from extending past this retainer when they flex and contact the retainer during the discharge stroke. The second noted class of valve structures includes a retainer and valve assembly generally centrally secured to the valve plate by a rivet or the like. In addition, springs have been utilized in cooperation with these valve retainers to bias the valves in the closed position.

A known type of multi-cylinder compressor provides discharge ports arranged in an arcuate fashion for each of its cylinders. The ports are closed by means of horseshoe-shaped leaf valves and retainers. The retainers are riveted or otherwise secured to the valve plate at the ends thereof, and curve slightly upwardly away from the valve plate to permit limited movement of the discharge valves.

A further known type of discharge valve assembly comprises a leaf valve that covers a plurality of discharge ports in the valve plate. A dish-shaped valve retainer riveted to the valve plate at its center curves upwardly slightly away from the valve plate, thereby permitting the discharge valve to flex outwardly and open discharge ports, yet at the same time preventing overflexing of the discharge valve.

The function and purpose of the discharge valve retainer is to permit limited flexing of the discharge valve yet avoid overflexing thereof, which would tend to highly stress and weaken the valve, thereby leading to possible failure.

SUMMARY OF THE INVENTION

The present invention provides an improved valve retainer for a fluid compressor having a housing with a crankcase; a cylinder block with at least two cylinders or compression chambers and pistons mounted therein to compress a fluid in response to a crankshaft or other drive means; and, a valve plate with discharge ports communicating between the compression chamber and a discharge chamber. The discharge ports are preferably provided at an outer radius of the compression chamber to increase the port area and thereby reduce discharge gas velocity. The discharge ports are sealed during the suction stroke of the pistons by discharge valves, and the travel of the discharge valves is limited by a retainer with at least a first annular portion and a second annular portion, which portions are secured to the valve plate. The first and second annular portions are curved or arced in a direction away from the valve plate about respective diameters which coincide with the locations where the retainers are secured to the plate. The first and second arced annuli are joined at a point between the valves. The retainers have a central bore, and the valve plate may have intake or suction ports with valve seals communicating through the central bore to a source of suction gas.

The advantage to the valve assembly of the present invention is that the discharge valves can be located in an annular pattern near the outer periphery of the cylinder. This provides more space for discharge porting, thereby reducing discharge gas velocity. The discharge valve retainers, which are preferably annular in shape, are joined together in a position generally between the valves for the respective cylinders. The retainers in this central portion are placed in tension as the discharge valves contact and press outwardly against the retainer during the discharge strokes of the pistons. This structure is significantly more rigid than a retainer structure wherein the free ends of the retainer are unsupported and can be flexed by the forces exerted by the discharge valve.

BRIEF DESCRIPTION OF THE DRAWINGS

In the figures of the drawing, like reference numerals identify like components and in the drawings.

DETAILED DESCRIPTION OF THE PREFERRED EMBODIMENT

Figure 1:
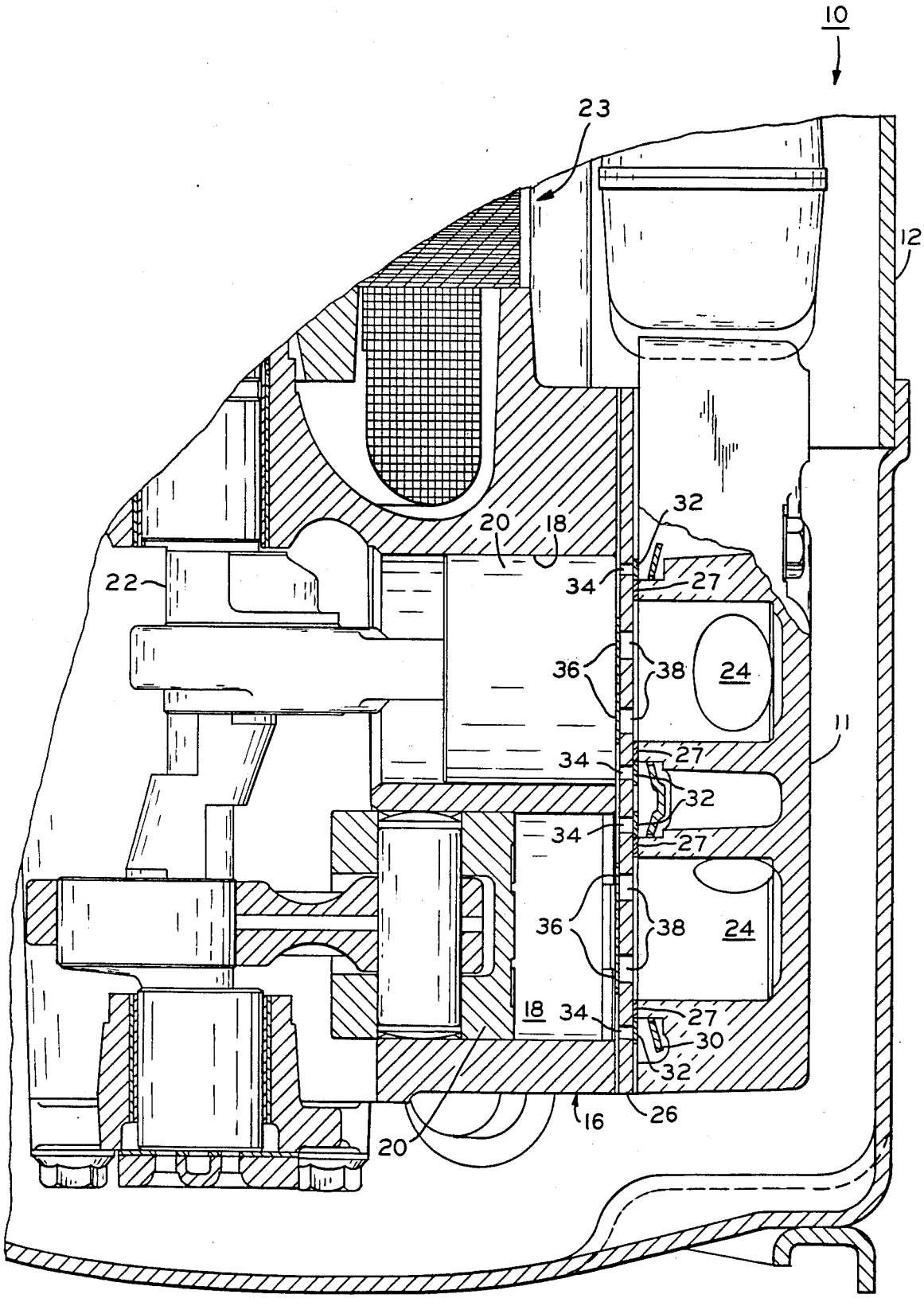
FIG. 1 is a partial cross-sectional side view of a multiple cylinder reciprocating compressor including the valve assembly of one form of the present invention.

A reciprocating hermetic compressor 10 includes a housing 12, head 11, a cylinder block 16 and a motor 23. Cylinder block 16 has at least two cylinders 18 with a reciprocating piston 20 in each of the piston cylinders 18. Pistons 20 are connected to and operable by a crankshaft 22 driven by motor 23.

Cylinder block 16 has a valve plate 26 mounted thereon in the usual fashion, and valve plate 26 includes intake or suction ports 38 and discharge ports 34. Suction ports 38 communicte between suction chambers 24 in head 11 and cylinders 18 through valve plate 26. Similarly discharge ports 34 communicate between cylinders 18 and discharge passage 28 in head 11 through valve plate 26. A gasket 27 is disposed between head 11 and valve plate 26. Annular discharge valves 32, which are operable to seal discharge ports 34, and valve retainer 30 are mounted to valve plate 26. As shown in FIG. 1, a suction valve 36 is positioned on valve plate 26 in cylinder 18 to seal suction ports 38 during the discharge stroke.

Figure 4:
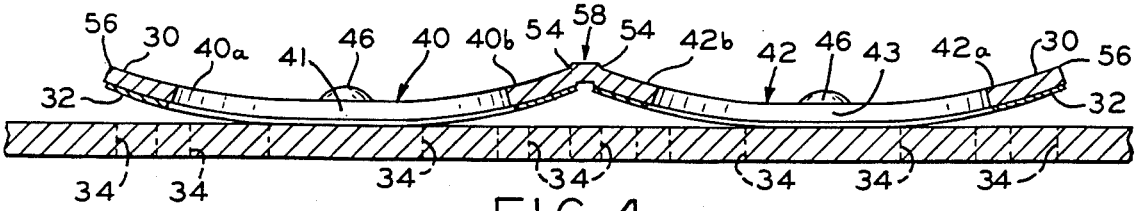
FIG. 4 is a cross-sectional view along line 4—4 in FIG. 2.
Figure 5:
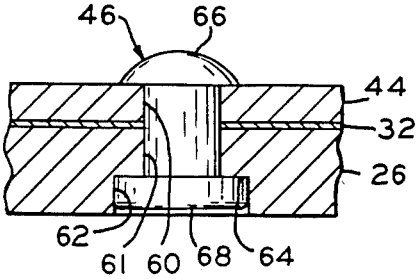
FIG. 5 is a cross-sectional view along line 5—5 of FIG. 2.

In a preferred embodiment valve retainer 30 (FIG. 2) includes a first portion 40 and a second portion 42 both with generally annular shapes. As these portions are substantially identical, only the first portion 40, will be described in detail and corresponding reference numerals will be applied to similar elements of portion 42. Portion 40 comprises an annulus 44 secured to valve plate 26 by diametrically-opposed, first and second rivets 46 and 48 passing through first holes 60 (FIG. 5)

and includes a centrally located opening 50. Suction ports 38 are generally centered in valve plate 26 below opening 50 of annulus 44 and above each of cylinders 18. As shown in FIGS. 1 and 4, portions 40 and 42 include segments 40a, 40b, 42a and 42b that extend from riveted portions 41 and 43, respectively, and curve away from valve plate 26 about an axis 52 through the diameter intersecting rivets 46 and 48. Each curved annulus 44 terminates in ends 54 and 56. First portion 40 and second portion 42 are preferably integral and are joined at one of their ends 54 at a junction 58.

Valve plate 26 has a plurality of second holes 61 with counterbores 62 and a shoulder 64 therebetween. First holes 60 are aligned with second holes 61 and retainer annuli 44 are secured to valve plate 26 by rivets or other securing means 46 and 48. As shown in FIG. 5, the head 68 of rivet 46 generally fills the counterbore 62 and upper portion 66 of rivet 46 is deformed to contact retainer annulus 44. Alternatively, the annuli 44 can be secured to plate 26 by welding or screwing.

Figure 3:
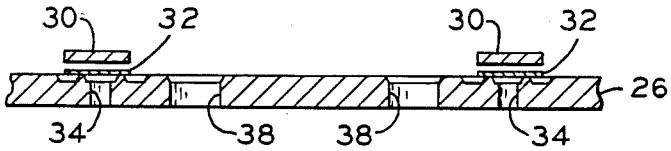
FIG. 3 is a cross-sectional view along line 3—3 in FIG. 2.

Compressor 10 operates in a conventional manner to draw in a compressible fluid on the intake stroke, compress the fluid on the compression stroke and force it out the discharge ports 34. At the suction stroke, intake valves 36 open and a compressible fluid, such as a refrigerant gas, is drawn into compression chamber 18. During the piston intake stroke discharge valves 32 are seated on valve plate 26 to seal discharge ports 34, as illustrated in FIG. 3. During the compression stroke, intake valves 36 are seated against valve plate 26 sealing intake ports 38, as shown in FIG. 1, and discharge valve 32 is forced by compressed fluid to open discharge ports 34, as shown in FIG. 4.

Discharge valves 32 are normally made of a spring steel or shape memory material which reseats the valves on discharge ports 34 during the intake stroke. The spring steel is susceptible to fatigue and fracture if deformed to too great an extend, therefore, valve travel is limited by a valve retainer 30.

Figure 2:
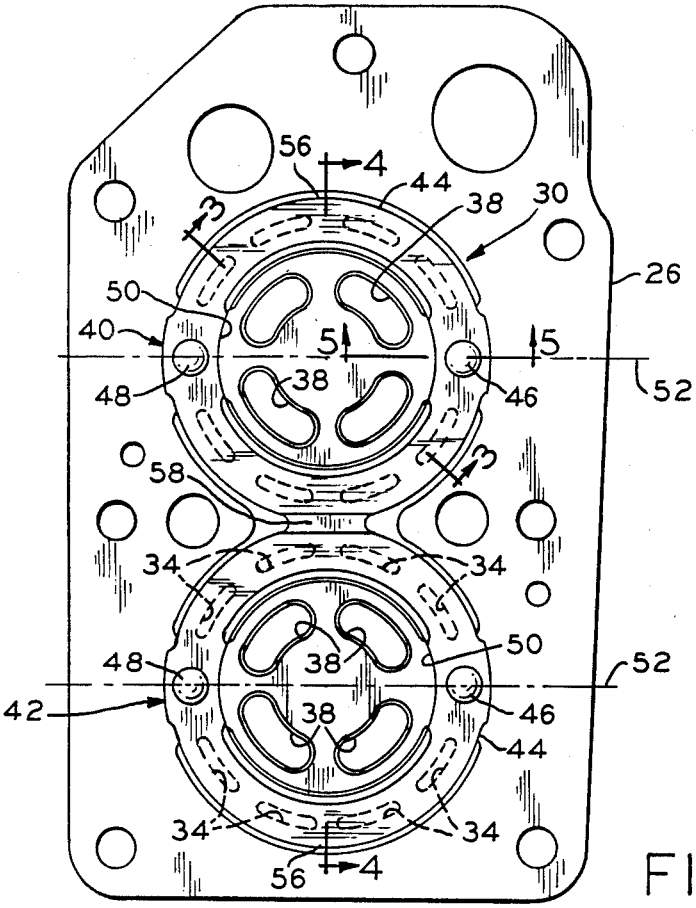
FIG. 2 is a plan view of the valve assembly illustrated in FIG. 1.

Retainer 30, as shown in FIGS. 2 and 4 with first and second portions 40 and 42 joined at junction 58, is secured to valve plate 26 and restricts the displacement of valves 32. As valve retainer portions 40 and 42 are connected together at junction 58, the central portion of valve retainer structure 30 is under tensile loading rather than bending forces during the discharge stroke, which would be the case with separate, unattached valve retainers. Thus, the center portion of valve retainer 30 is extremely rigid and resistant to tensile loading, thereby limiting the deflection of discharge valve 32 in this central region without bending or flexing. This results in reduced fatigue and wear of valve retainer 30 and provides for a more rigid positive stop for the discharge valves 32 without the necessity of over building retainer 30 or utilizing additional structural devices to further stiffen it.

The valve assembly described above continues to allow compressed gasses to be discharged at the outside radii of cylinders 18. This outer discharge pattern reduces discharge gas velocity and improves the fluid flow from compression chamber 18.

The invention can be used in reciprocating compressors, wobble plate compressors, as well as other types of compressors. The multiple retainer arrangement provides a ready means of improving the longevity and rigidity of the retainers, achieves a desirable porting pattern and minimizes costs as there are no springs nor poppet-like valves with difficult cast passageways in the associated cylinder block or manifold. All of these advantages lead to an improved product and economy of manufacture.

While only a specific embodiment of the invention has been described and shown, it is apparent that various alterations and modifications can be made therein. It is, therefore, the intention the appended claims to cover all such modifications and alterations as may fall within the true scope and spirit of the invention.

What is claimed is:

1. A fluid compressor comprising:

a cylinder block defining at least two cylinders with pistons operable therein for compressing a fluid;

a valve plate on said cylinder block including at least one suction port and at least one discharge port for each of said cylinders;

annular discharge valve means mounted on said valve plate cooperating with each of said cylinders and operable for sealing the discharge ports associated therewith;

suction valve means for each of said cylinders operable for sealing said suction ports associated therewith; and a valve retainer for limiting discharge valve travel, said retainer mounted on said valve plate, and comprising a first annular portion and a second annular portion adjacent said first portion positioned to retain said discharge valve means between said retainer and said valve plate;

first and second means for securing said first annular portion to said valve plate at substantially diametrically opposed locations on said first annular portion; said first annular portion curving upwardly from said valve plate on both sides of said diametrically opposed locations and terminating in upper ends;

first and second means for securing said second annular portion to said valve plate at substantially diametrically opposed locations on said second annular portion, said first annular portion curving upwardly from said valve plate on both sides of its said diametrically opposed locations and terminating in upper ends;

whereby the joined annular portions are in tension in a center region of said retainer to thereby provide increased rigidity.

2. A fluid compressor assembly as claimed in claim 1 wherein said valve retainer securing means are rivets.

3. A fluid compressor assembly as claimed in claim 1 and further comprising a head assembly with a discharge chamber and suction chamber wherein each of said valve retainer portions include a central opening, said suction ports being located generally within said central opening for providing communication between said suction chamber and suction ports.

4. The fluid compressor of claim 1 including a plurality of discharge ports arranged in an annular pattern, and said suction port is disposed radially inside of said annularly arranged discharge ports.

5. The fluid compressor of claim 1 wherein said retainer portions are integrally joined at said adjacent uppr ends.

6. A compressor comprising: a cylinder block defining at least two cylinders with pistons operable therein for compressing a fluid; a valve plate mounted on said cylinder block and including at least one discharge port for each of said cylinders, annular discharge valve means mounted on a surfce of said valve plate cooperating with each of said cylinders and operable for sealing the discharge ports associated therewith; and a valve retainer secured to said valve plate, said valve retainer comprising two adjacent annular portions respectively generally overlying said discharge valve means, said annular portions each being secured to said valve plate at two opposed locations along a generally mediately located region of said annular portion and each comprising a pair of generally arcuate segments extending from said mediately located region and extending away from said valve plate surface and terminating in ends spaced from said valve plate surface, one of said ends of one of said annular portions being adjacent to one of said ends of the other annular portion, said adjacent ends being joined together;

whereby the joined annular portions are in tension in a center region of said retainer to thereby provide increased rigidity.

7. The compressor of claim 6 wherein said valve plate includes suction ports disposed generally radially inside of said annular discharge valve means.

8. A fluid compressor comprising: a cylinder block defining at least two cylinders with pistons operable therein for compressing a fluid, a valve plate on said cylinder block including at least one discharge port for each of said cylinders, discharge valve means mounted on a surface of said valve plate cooperating with each of said cylinders and operable for sealing the discharge ports associated therewith, and a valve retainer secured to said valve plate, said valve retainer comprising two adjacent portions respectively generally overlying said discharge valve means, said portions each being secured to said valve plate along a generally mediately located region of said portion and each comprising a pair of segments extending from said mediately located region and extending away from said valve plate surface and terminating in ends spaced from said valve plate surfce, one of said ends of one of said portions being adjacent to one of said ends of the other portion, said adjacent ends being joined together, whereby the joined segments of each retainer portion are in tension to thereby provide increased rigidity.

9. The compressor of claim 8 wherein said segments curve away from said valve plate surface in an arcuate fashion.

* * * * *

UNITED STATES PATENT AND TRADEMARK OFFICE

CERTIFICATE OF CORRECTION

PATENT NO. : 4,721,443

DATED : January 26, 1988

INVENTOR(S) : Charles C. Allen C-151

It is certified that error appears in the above-identified patent and that said Letters Patent is hereby corrected as shown below:

Col. 1, line 10, change "vlves" to --valves--;
Col. 2, line 49, change "communicte" to --communicate--;
Col. 3, line 38, change "extend" to --extent--;
Claim 1, Col. 4, after line 43, insert the following subparagrap
--said first and second annular portions being joined together at respective adjacent said upper ends;--
Claim 5, Col. 4, line 62, change "uppr" to --upper--;
Claim 6, Col. 4, line 69, change "surfce" to --surface--.

Signed and Sealed this

Twelfth Day of July, 1988

*Attest:*

*Attesting Officer*

DONALD J. QUIGG

*Commissioner of Patents and Trademarks*